United States Patent [19]

Cook et al.

[11] 3,945,723

[45] Mar. 23, 1976

[54] RESILIENT ROLLER

[75] Inventors: John Hayward Cook, Sawbridgeworth; John Wales, Bishops Stortford, both of England

[73] Assignee: Xerox Corporation, Stamford, Conn.

[22] Filed: July 19, 1974

[21] Appl. No.: 490,145

[30] Foreign Application Priority Data

Sept. 7, 1973 United Kingdom ..... 42181/73

[52] U.S. Cl. ..... 355/3 R; 29/130; 354/318

[51] Int. Cl.[2] ..... G03G 15/00; G03D 5/00

[58] Field of Search ..... 355/3, 10; 354/318, 319

[56] References Cited

UNITED STATES PATENTS

| | | | |
|---|---|---|---|
| 3,086,100 | 4/1963 | Carozza | 354/319 |
| 3,435,500 | 4/1969 | Aser et al. | 29/130 |
| 3,500,793 | 3/1970 | Bartusek | 354/319 |
| 3,592,134 | 7/1971 | Patterson, Jr. | 101/269 |
| 3,596,635 | 8/1971 | Smitzer | 354/318 |
| 3,667,428 | 6/1972 | Smith | 355/10 |
| 3,667,987 | 6/1972 | Miller | 354/319 |
| 3,702,096 | 11/1972 | Copeland | 354/318 |
| 3,710,469 | 1/1973 | Kitazawa | 29/125 |
| 3,801,315 | 4/1974 | Gundlach et al. | 96/1.4 |

FOREIGN PATENTS OR APPLICATIONS

| | | | |
|---|---|---|---|
| 1,112,180 | 11/1955 | France | 354/318 |
| 2,095,107 | 4/1972 | France | 354/318 |
| 391,788 | 5/1933 | United Kingdom | 354/318 |
| 892,984 | 4/1962 | United Kingdom | 354/318 |
| 1,124,036 | 8/1968 | United Kingdom | 354/318 |

*Primary Examiner*—Stephen J. Tomsky

*Attorney, Agent, or Firm*—James J. Ralabate; Anthony W. Karambelas; Paul A. Leipold

[57] ABSTRACT

A resilient roller is described having a rigid shaft and a flexible sleeve spaced apart by a resilient member to which axial pressure is applied. The axial pressure translates through the resilient member to become outward radial pressure. The roller of the invention is sufficiently resilient across its functional surface to maintain substantial contact and a substantially uniform nip width along its line of axial tangency with a cooperating surface.

13 Claims, 3 Drawing Figures

RESILIENT ROLLER

BACKGROUND OF THE INVENTION

This invention relates to electrostatographic development apparatus and more specifically to such apparatus wherein substantially uniform contact and substantially uniform nip width is maintained between an imaging member and a developer applicating means.

U.S. Pat. No. 3,084,043 teaches an apparatus and method for the liquid development of electrostatic latent images wherein the liquid developer is presented to a photoreceptor having an electrostatic latent image on its surface. The liquid developer is presented by means of an applicator comprising lands and valleys such that the liquid developer is contained in the valleys out of contact with the photoreceptor, while the surfaces of the lands are in contact with the photoreceptor. In such an arrangement, the liquid developer is attracted from the valleys to the electrostatic latent image in image configuration. A typical example of such an arrangement is an electrostatographic copying apparatus wherein the applicator is a rigid cylindrical member having on its surface a pattern of grooves and ridges which comprise lands and valleys, respectively. A liquid developer is maintained in the valleys below the surface of the lands. The applicator is positioned to come into contact with a photoreceptor bearing on its surface an electrostatic latent image. In a typical electrostatographic copying apparatus the photoreceptor is also a cylindrical member comprising a conductive substrate and a photoconductive coating which supports the electrostatic latent image. The electrostatic latent image is typically produced by first charging the entire surface of the photoreceptor in the dark and then by exposing the charged surface to imagewise radiation.

The portions of the charged photoreceptor surface which are struck by the radiation are discharged, leaving an image pattern of charge on the photoreceptor surface to the non-radiation-struck areas.

The photoreceptor surface bearing the electrostatic latent image and the applicator are brought into moving contact during which the liquid developer is drawn to the photoreceptor from the valleys of the applicator roller by the charges which form the electrostatic latent image. Typically the image is then transferred to an image receiving member such as paper by pressure contact between the photoreceptor and a roller.

Although both of the surfaces may be flat, it is more common for at least one of the surfaces to be arcuate to facilitate the moving of the applicator past sequential points on the photoreceptor while the two are in contact. In compact electrostatographic copying devices the surfaces are typically small diameter cylinders to facilitate the cooperative movement of the surfaces in a confined space. Such movement typically occurs at speeds of about four inches per second, although moving contact resulting in the transfer of liquid developer from the applicator to the photoreceptor occurs at speeds ranging generally from about two to about 70 inches per second.

Although satisfactory visible and recognizable images can be produced by such an apparatus and method, they have frequently been found to lack uniform density. Typically areas of the image which have the same shade of color or density in the original have areas of varying density in the developed image and final copy. Such typical characteristics of the developed image are generally considered unsatisfactory, not pleasing to the eye, and are indices of unacceptable copy quality.

The use of a deformable surface, as either the applicator surface or the photoreceptor surface in such an electrostatographic development apparatus or method when at least one of such surfaces is arcuate provides substantially uniform contact and a substantially uniform nip width between the surfaces.

It has been found that substantially uniform contact between the surfaces is achieved whenever the gap distance between adjacent portions of the surfaces while they are maintained in contact is less than about 0.0005 inch along the line of tangency between the surfaces. In one embodiment a rigid applicator surface has an overall variation along its line of tangency with the photoreceptor of not more than about 0.002 inch and a variation from land to land of not more than about 0.0005 inch. A deformable photoreceptor having a hardness of about 30° as measured on a Shore A Durometer contacts the land surfaces. The gap between the deformable photoreceptor surface and the lands of the rigid applicator surface in such an arrangement is maintained at about 0.0005 inch or less to provide substantial contact between the surfaces.

The nip width in that exemplary embodiment is the zone of substantial contact between the two surfaces. Substantially uniform nip width, is achieved whenever the zone of substantial contact between the surfaces varies not more than about ten fold. A preferred nip width variation is about ± 50%. In the embodiment described just above, the photoreceptor is the deformable member. However, it is to be understood that the applicator may be the deformable member. The deformable member may have a hardness of up to about 90° (as measured on a Shore A durometer). For producing copies of consistent sharpness and clarity a preferred hardness is from about 40° to about 70°, and optimum print quality is achieved from about 50° to about 60°. An important aspect of the arrangement described above is the ability of the deformable surface to maintain its functional integrity during deformation. That is, the deformable member, whether the applicator or the photoreceptor continues to provide its intended function during deformation.

The establishing of a substantially uniform nip width and of substantial contact as the surfaces move in operative contact provides substantially uniform periods of time during which the liquid developer is able to move from the applicator valleys to the photoreceptor surface across a substantially uniform gap of less than 0.0005 inch. Thus, substantially uniform amounts of liquid developer are transferred to the photoreceptor in response to substantially equally charged portions of the image.

Although it is desired to maintain substantially uniform contact and substantially nip width between an imaging member and a developer applicator means adequate an expedient method to provide same have not as yet been successfully devised.

It is therefore an object of this invention to provide an electrostatographic development apparatus devoid of the above-noted deficiencies.

Another object of this invention is to provide a novel electrostatographic development apparatus wherein substantially uniform contact and substantially nip width is maintained between an imaging member and the developer applicator means to provide satisfactory development.

These and other objects are obtained in accordance with the apparatus of the instant invention generally speaking by providing a roller which is sufficiently resilient across its functional surface to maintain substantial contact and a substantially uniform nip width along its line of axial tangency with a cooperating surface, said roller comprising a rigid central member, a flexible sleeve, and an elastic substance positioned between the flexible sleeve and the rigid member, in which the elastic substance is axially compressed.

Photoreceptor members and applicators in the form of resilient rollers formed in accordance with the present invention provide for the development of electrostatic latent images of similar or equal potential by the application or deposition of substantially equal amounts of developer per respective image potentials. Preferably the nip width variation in cooperating use is not more than about ten fold, the resilient roller has a linear variation along its line of tangency of not more than about 0.002 inches and a variation from land to land of not more than about 0.0005 inches, and its surface hardness is in the range 40° to 70° (as measured on a Shore A durometer), and optimumly of from about 50° to about 60°. Such preferred features provide developed images having densities corresponding to those of the original image.

Referring now to the drawings, the invention is described in greater detail in which.

Figure 1:
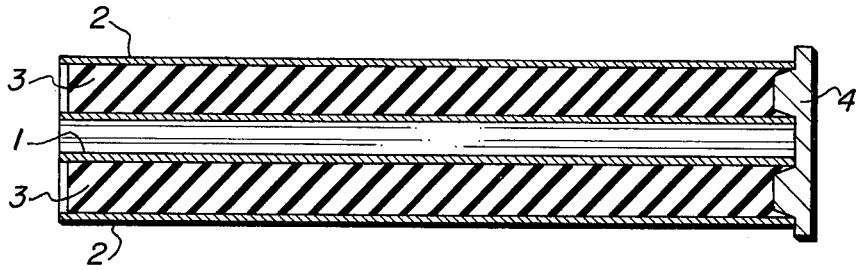
FIG. 1 shows a longitudinal sectional view of resilient roller.

Referring now to the drawings there is shown in FIG. 1 a rigid core 1, which comprises in this embodiment an aluminum tube. Any material suitable for forming a rigid roller may be used. Typical such materials are aluminum steel, copper, wood, hard rubber and hard plastic. The rigid central core may be a solid roller or a tube so long as longitudinal rigidity is maintained. Also shown in FIG. 1 is a sleeve 2, which is comprised of a material having a thickness which allows it to be flexible. Flexible sleeve 2, shown, is a photoreceptor sleeve which comprises an extruded brass substrate coated with selenium.

The photoreceptor may comprise any suitable photoconductive material coated on any suitable conductive base. Typical photoconductors are selenium, selenium alloys, halogen doped selenium and zinc oxide in a resin binder. Typical substrates are nickel, brass and aluminum. There may be an interface layer between the photoconductive material and the substrate to provide selected adhesive or electrical properties and there may be an insulating coating over the photoreceptor.

Flexible sleeve 2 has an inside diameter which is sufficiently larger than the outside diameter of the rigid core 1 that flexible sleeve 2 will slip over the rigid core 1 leaving a free space between all points on the inside diameter of the flexible sleeve 2 and the outside diameter of the rigid core 1. The flexible sleeve 2 and the rigid central core 1 are spaced apart by an elastic substance 3.

Any suitable elastic substance may be employed between the flexible sleeve and the rigid central core as seen in FIG. 1. Any rubber or rubber-like material, e.g., neoprene, capable of imparting resiliency to the flexible sleeve and evenly distributing a compressive force across the face of the flexible sleeve may be employed. Typical of such materials are nitrile, butyl, polyurethane and silicone rubbers.

The elastic substance is provided as a shaped member which is placed between the rigid central member and the flexible sleeve. The interfaces between the elastic substance and both rigid central member and the flexible sleeve may be lubricated. Such lubrication is observed to ease placement of the elastic substance between the rigid central member and the flexible sleeve. Although any suitable lubricant may be used, dry lubricants typified by graphite are preferred.

A compressive force is applied to elastic substance 3 in FIG. 1 by end plate 4 which is shaped so as to produce an axial compressive force when positioned as shown. In FIG. 1, shaped end plate 4 is on one end of the resilient roller; however, it is to be understood that a shaped end plate may be on each end of the roller. Only one shaped end plate may be used in which case at the opposite end a plane faced end plate or end cover is normally provided. The plane faced cover can be replaced by a flange fixed to or forming part of the central member if desired. The end plates may assume any shape sufficient to exert an axial compressive pressure on the elastic substance 3 to achieve a surface on the face of the roller of from about 30° to about 90° (Shore A durometer). The shaped end plates are shown in the drawings as typical means of applying compressive pressure to the elastic substance. Other means such as using plane faced end plates and providing an axially over-sized elastic substance 3 so that when the roller is assembled with its end plates in position, the elastic substance 3 is axially compressed. When compressive force is exerted against the elastic substance as described, the elastic substance tends to act like a highly viscous liquid to at least substantially evenly distribute the radial force exerted on the flexible sleeve 2.

Figure 2:
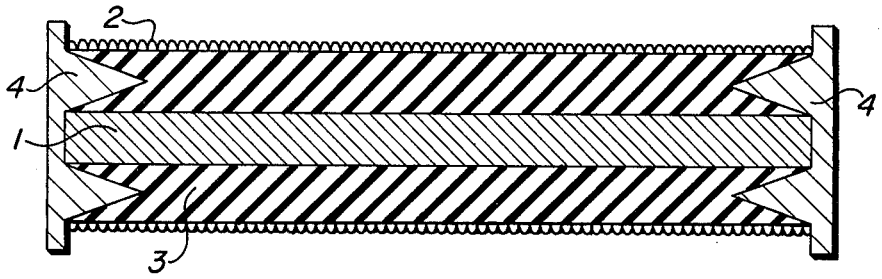
FIG. 2 shows a longitudinal sectional view of another form of the resilient roller.

Referring now to FIG. 2, a flexible sleeve 2 is spaced apart from a rigid central core 1 by a silicone rubber member 3. Flexible sleeve 2 in FIG. 2 is an applicator means for use in liquid development of electrostatic latent images, said means comprising a pattern of lands and valleys on the functional surface of the sleeve. The applicator means may be made from any suitable flexible material having the ability to maintain a land and valley surface configuration during flexing and its functional integrity during use in an electrostalographic device. Typical such materials are plastic and metal foils. Also shown in the embodiment of FIG. 2 are shaped end plates 4 which are positioned so as to exert a compressive force on the elastic substance 3, sufficient to achieve surface hardness of from about 30° to about 90° (Shore A durometer). The shaped end plates 4 may be of any configuration which will exert a compressive force on rubber member 3 when the end plates 4 are in position. Although two shaped end plates 4 are shown in FIG. 2, it will be appreciated that other arrangements, such as have been described with reference to FIG. 1 can be provided to provide the compressive force.

Figure 3:
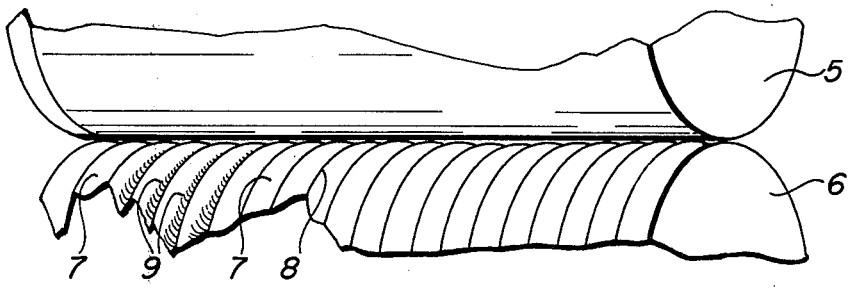
FIG. 3 shows schematically a resilient photoreceptor roller cooperating with a rigid applicator roller.

Referring more specifically now to FIG. 3, there is shown schematically a resilient photoreceptor roller 5, working in cooperation with a rigid liquid developer applicator roller 6 which is formed from a hard material in such a way that it has grooves 7 and ridges 8 on its operating surface which act respectively, as valleys and lands. A liquid developer 9 is contained in the valleys and upon cooperative motion of the two rollers the liquid developer 9 is presented to the photoreceptor 5, to develop any electrostatic latent images thereon. As shown in FIG. 3 the line of axial contact between the resilient photoreceptor roller 5 and the lands of the applicator roller 6 is uneven. However, the resilient properties of the resilient roller allow substantially uniform contact and a substantially uniform nip width between the surface of the resilient rollers and the uneven ridges 8 without sufficient distortion of the surface of photoreceptor 5 to affect its operation. It is to be understood that in referring to FIG. 3 the applicator roller may be the resilient roller, and the photoreceptor surface may be rigid. In such a configuration the resilient surface of the applicator roll would flex to maintain a contact between its lands and the uneven surface of the photoreceptor.

Although the present examples were specific in terms of conditions and materials used, any of the above listed typical materials may be substituted when suitable in the above examples with similar results. In addition to the steps used to carry out the process of the present invention, other steps or modifications may be used if desirable. In addition, other materials may be incorporated in the system of the present invention which will enhance, synergize or otherwise desirably affect the properties of the systems for their present use.

Anyone skilled in the art will have other modifications occur to him based on the teachings of the present invention. These modifications are intended to be encompassed within the scope of this invention.

What is claimed is:

1. A cylindrical member which is sufficiently resilient across its functional surface to maintain substantial line of axial tangency with a rigid cooperating surface, said roller comprising a rigid central member, a flexible sleeve, and an elastic substance positioned between the flexible sleeve and the rigid member, in which said elastic substance is axially compressed.

2. The roller as defined in claim 1 wherein the rigid central member is selected from the group consisting of rigid metals, wood, plastic and hard rubber.

3. The roller as defined in claim 1 wherein the flexible sleeve is a liquid developer applicator.

4. The roller as defined in claim 1 wherein the flexible sleeve is a patterned surface, said pattern comprising recesses capable of containing a liquid developer.

5. The roller as defined in claim 4 wherein the pattern comprises grooves with ridges therebetween.

6. The roller as defined in claim 1 wherein the flexible sleeve is a photoreceptor.

7. The roller as defined in claim 6 wherein the photoreceptor comprises a photoconductive layer on a conductive substrate.

8. The roller as defined in claim 7 wherein the layer is selected from the group consisting of selenium and zinc oxide in a resin binder.

9. The roller of claim 8 wherein the elastic substance is selected from the group consisting of neoprene, nitrile, butyl, polyurethane and silicone rubbers.

10. The roller as defined in claim 1 wherein the interface between the elastic substance, the flexible sleeve and the rigid central member is lubricated.

11. The roller as defined in claim 10 wherein the interface is lubricated by a dry lubricant.

12. The roller as defined in claim 1 wherein the elastic substance is compressed by force applied by a shaped end plate.

13. The roller as defined in claim 12 wherein there is provided a shaped end plate at each end of the roller.

* * * * *